US010935933B2

(12) United States Patent
Di Domenico et al.

(10) Patent No.: US 10,935,933 B2
(45) Date of Patent: Mar. 2, 2021

(54) TIMEPIECE OSCILLATOR WITH FLEXURE BEARINGS HAVING A LONG ANGULAR STROKE

(71) Applicant: The Swatch Group Research and Development Ltd, Marin (CH)

(72) Inventors: Gianni Di Domenico, Neuchatel (CH); Pierre Cusin, Villars-Burquin (CH); Jean-Luc Helfer, Le Landeron (CH); Alex Gandelhman, Neuchatel (CH); Pascal Winkler, St-Blaise (CH); Baptiste Hinaux, Lausanne (CH); Dominique Lechot, Les Reussilles (CH); Olivier Matthey, Grandson (CH); Laurent Klinger, Bienne (CH); Jerome Favre, Neuchatel (CH)

(73) Assignee: The Swatch Group Research and Development Ltd, Marin (CH)

( * ) Notice: Subject to any disclaimer, the term of this patent is extended or adjusted under 35 U.S.C. 154(b) by 12 days.

(21) Appl. No.: 16/511,191

(22) Filed: Jul. 15, 2019

(65) Prior Publication Data

US 2020/0033805 A1 Jan. 30, 2020

(30) Foreign Application Priority Data

Jul. 24, 2018 (EP) ..... 18185138

(51) Int. Cl.
*G04B 17/10* (2006.01)

(52) U.S. Cl.
CPC ..... *G04B 17/10* (2013.01)

(58) Field of Classification Search
CPC ..... G04B 17/04; G04B 17/045; G04B 17/28; G04B 17/30; G04B 15/14; G04B 31/00;
(Continued)

(56) References Cited

U.S. PATENT DOCUMENTS 3,269,106 A * 8/1966 Waldburger ..... G04B 17/045 368/168
3,528,308 A * 9/1970 Favre ..... G04C 3/107 74/142

(Continued)

FOREIGN PATENT DOCUMENTS

CN 103858061 A 6/2014
CN 104062883 A 9/2014

(Continued)

OTHER PUBLICATIONS

European Search Report dated Jan. 25, 2019 in European Application 18185138.7, filed on Jul. 24, 2018 (with English Translation of Categories of Cited Documents and Written Opinion).

*Primary Examiner* — Edwin A. Leon
(74) *Attorney, Agent, or Firm* — Oblon, McClelland, Maier & Neustadt, L.L.P.

(57) ABSTRACT

A mechanical timepiece oscillator includes, between a support and an inertial element, a flexure bearing with flexible strips crossed in projection, including, superposed, an upper level that includes, between an upper support and an upper inertial element, an upper primary strip in a first direction and an upper secondary strip in a second direction, and a lower level that includes, between a lower support and a lower inertial element, a lower primary strip in the first direction and a lower secondary strip in the second direction. The upper level and lower level include, between the support and the upper or respectively lower support, a translational table with an elastic connection along one or two axes of freedom in the oscillation plane, of lower stiffness than that of each flexible strip.

18 Claims, 7 Drawing Sheets

(58) Field of Classification Search
CPC ..... G04B 17/10; G04B 13/026; G04B 17/32; G04B 31/004; G04B 17/26; G04B 31/02; G04C 3/102; G04C 3/008; G04C 3/101
USPC ..... 368/169–170
See application file for complete search history.

(56) References Cited

U.S. PATENT DOCUMENTS

| | | | | |
|---|---|---|---|---|
| 3,628,781 | A | 12/1971 | Grib | |
| 9,134,705 | B2 * | 9/2015 | Vardi | G04B 17/045 |
| 9,477,205 | B2 * | 10/2016 | Born | G04C 3/101 |
| 9,983,549 | B2 * | 5/2018 | Winkler | G04B 17/06 |
| 2018/0136609 | A1 | 5/2018 | Winkler et al. | |

FOREIGN PATENT DOCUMENTS

| | | | |
|---|---|---|---|
| CN | 104730898 | A | 6/2015 |
| CN | 105717777 | A | 6/2016 |
| CN | 106662839 | A | 5/2017 |
| EP | 2 998 800 | B1 | 3/2016 |
| EP | 3 324 247 | A1 | 5/2018 |
| EP | 3 327 515 | A1 | 5/2018 |
| WO | WO 2018109584 | A1 | 6/2018 |

* cited by examiner

SETI

TIMEPIECE OSCILLATOR WITH FLEXURE BEARINGS HAVING A LONG ANGULAR STROKE

This application claims priority to European Patent Application No. 18185138.7, filed Jul. 24, 2018, the entire contents of which are incorporated herein.

FIELD OF THE INVENTION

The invention concerns a mechanical timepiece oscillator comprising, between a first rigid support element and a solid inertial element, a flexure bearing with at least two first flexible strips which support said solid inertial element and are arranged to return it to a rest position, wherein said solid inertial element is arranged to oscillate angularly in an oscillation plane about said rest position, said two first flexible strips do not touch each other and their projections onto said oscillation plane cross, in the rest position, at a crossing point, in proximity to which or through which passes the axis of rotation of said solid inertial element perpendicularly to said oscillation plane, and the embedding points of said first flexible strips in said first rigid support element and said solid inertial element define at least two strip directions parallel to said oscillation plane.

The invention also concerns a timepiece movement including at least one such mechanical oscillator.

The invention also concerns a watch including such a timepiece movement.

The invention concerns the field of mechanical oscillators for timepieces comprising bearings with flexible strips performing the functions of holding and returning movable elements.

BACKGROUND OF THE INVENTION

The use of flexure bearings, particularly having flexible strips, in mechanical timepiece oscillators, is made possible by processes, such as MEMS, LIGA or similar, for developing micromachinable materials, such as silicon and silicon oxides, which allow for very reproducible fabrication of components which have constant elastic characteristics over time and high insensitivity to external agents such as temperature and moisture. Flexure pivots, such as those disclosed in European Patent Applications EP1419039 or EP16155039 by the same Applicant, can, in particular, replace a conventional balance pivot, and the balance spring usually associated therewith. Removing pivot friction also substantially increases the quality factor of an oscillator. However, flexure pivots generally have a limited angular stroke, of around 10° to 20°, which is very low in comparison to the usual 300° amplitude of a balance/balance spring, and which means they cannot be directly combined with conventional escapement mechanisms, and especially with the usual stopping members such as a Swiss lever or suchlike, which require a large angular stroke to ensure proper operation.

At the International Chronometry Congress in Montreux, Switzerland, on 28 and 29 Sep. 2016, the team of M. H. Kahrobaiyan first addressed the increase in this angular stroke in the article 'Gravity insensitive flexure pivots for watch oscillators', and it appears that the complex solution envisaged is not isochronous.

EP Patent Application No 3035127A1 in the name of the same Applicant, SWATCH GROUP RESEARCH & DEVELOPMENT Ltd discloses a timepiece oscillator comprising a time base with at least one resonator formed by a tuning fork, which includes at least two oscillating moving parts, wherein said moving parts are fixed to a connection element, comprised in said oscillator, by flexible elements whose geometry determines a virtual pivot axis having a determined position with respect to said connection element, said respective moving part oscillates about said virtual pivot axis and the centre of mass of said moving part coincides in the rest position with said respective virtual pivot axis. For at least one said moving part, said flexible elements are formed of crossed elastic strips extending at a distance from each other in two parallel planes, and whose directions, in projection onto one of said parallel planes, intersect at said virtual pivot axis of said moving part concerned.

U.S. Pat. No. 3,628,781A in the name of GRIB discloses a tuning fork, in the form of a dual cantilever structure, for causing a pair of movable elements to have accentuated rotational motion, relative to a stationary reference plane comprising a first elastically deformable body having at least two elastically similar elongated bendable portions, the ends of each of said bendable portions being respectively integral with enlarged rigid portions of said element, the first of said rigid portions being fixed to define a reference plane and the second being elastically supported to have accentuated rotational motion relative to the first, a second elastically deformable body substantially identical to the first elastically deformable body, and means for rigidly securing the first of said respective rigid portions of said elastically deformable bodies in spaced relation to provide a tuning fork structure wherein each of the tines of the tuning fork comprises the free end of one of said elastically deformable bodies.

European Patent Application No EP 3324247A1 in the name of the same Applicant, SWATCH GROUP RESEARCH & DEVELOPMENT Ltd, discloses a strip resonator for a mechanical watch movement, arranged to be fixed to a main plate of a movement or to form a main plate, wherein the resonator includes a fixed structure, arranged to be fixed to the main plate or to form the main plate, and with respect to which fixed structure at least one inertial element is arranged to vibrate and/or oscillate, and the resonator includes at least one resilient strip extending between, at a first end, a first anchor point arranged on the fixed structure and, at a second end, a second anchor point arranged on at least one inertial element, and the strip is arranged to vibrate essentially in a main plane. This strip forms a bearing for the inertial element in the main plane. To protect the strips comprised therein from shocks, resonator 1000 includes, on the first anchor point and/or the second anchor point, at least one flat anti-shock device arranged to protect each strip against breakage in case of shock, this flat, anti-shock device including at least a first flexible element, preloaded with a prestress force in said main plane, set at a predetermined safe stress value, EP Patent Application No. 2998800A2 in the name of PATEK PHILIPPE discloses a timepiece component with a flexible pivot, including a first monolithic part defining a first rigid portion and a second rigid portion connected by at least a first elastic strip, and a second monolithic part defining a third rigid portion and a fourth rigid portion connected by at least a second elastic strip, wherein the first and second monolithic parts are assembled to each other such that the first and third rigid portions are integral with each other and the second and fourth rigid portions are integral with each other. The at least one first elastic strip and the at least one second elastic strip intersect contactlessly and define a virtual axis of rotation for the second and fourth rigid portions with respect to the first and third rigid portions. This component includes a bearing, integral with the second and fourth rigid portions and intended to guide rotation of an element moving about an axis distinct from the virtual axis of rotation and substantially parallel thereto.

European Patent Application No. EP3130966A1 in the name of ETA Manufacture Horlogère, Switzerland, discloses a mechanical timepiece movement which includes at least one barrel, a set of gear wheels driven at one end by the barrel, and an escapement mechanism of a local oscillator with a resonator in the form of a balance/balance spring and a feedback system for the timepiece movement. The escapement mechanism is driven at another end of the set of gear wheels. The feedback system includes at least one precise reference oscillator combined with a rate comparator to compare the rate of the two oscillators and a mechanism for regulating the local oscillator resonator to slow down or accelerate the resonator based on the result of the comparison in the rate comparator.

Swiss Patent Application No. CH709536A2 in the name of ETA SA Manufacture Horlogère Suisse discloses a timepiece regulating mechanism which comprises, mounted to move in at least a pivoting motion with respect to a plate, an escape wheel arranged to receive a drive torque via a gear train, and a first oscillator comprising a first rigid structure connected to said plate by first elastic return means. This regulating mechanism includes a second oscillator comprising a second rigid structure, connected to said first rigid structure by second elastic return means, and which includes bearing means arranged to cooperate with complementary bearing means comprised in said escape wheel, synchronizing said first oscillator and said second oscillator with said gear train.

European Patent Application No. EP 17183666 by the same Applicant and incorporated herein by reference, discloses a pivot with a large angular stroke. By using an angle between the strips of approximately 25° to 30°, and a crossing point located at approximately 45% of their length, it is possible to simultaneously obtain good isochronism and position insensitivity over a large angular stroke (up to 40° or more). In order to maximise the angular stroke while maintaining good out-of-plane stiffness, the strips are made thinner but of longer length. The use of a high aspect ratio value, i.e. the ratio of the height of the strip to its thickness, is theoretically advantageous, but in practice the phenomenon of anticlastic curvature is often encountered, which impairs properties.

SUMMARY OF THE INVENTION

The invention proposes to develop a mechanical oscillator with flexure bearings whose angular stroke is compatible with existing escapement mechanisms, and whose flexure bearings behave in a regular manner regardless of any deformation.

This resonator with a rotational flexure bearing must have the following properties:

high quality factor;

large angular stroke;

good isochronism;

high position insensitivity in space.

Considering the particular case of a flexure bearing with strips crossed in projection in a plane parallel to the oscillation plane, wherein said strips join a stationary mass and a moving mass, the possible angular stroke $\theta$ of the pivot depends on the relation X=D/L between, on the one hand the distance D from the embedding point of a strip in the stationary mass and the crossing point, and on the other hand, the total length L of the same strip, in its elongation, between its two opposite embedding points. The aforementioned work of the team of M. H. Kahrobaiyan shows that this possible angular stroke $\theta$, for a given pair of strips with a given vertex angle $\alpha$ at the crossing point, which is 90° here, is maximal where X=D/L=0.5, and decreases rapidly away from this value, in a substantially symmetrical curve. However, such a cross-strip pivot where X=D/L=0.5 and $\alpha$=90° is not isochronous.

Consequently, the invention explores the ranges of advantageous combinations between the values of vertex angle $\alpha$ at the crossing point of the strips, and the values of ratio X=D/L, in order to obtain isochronous pivots, and optimum values of the aspect ratio of each of the strips.

To this end, the invention concerns a mechanical oscillator according to claim 1.

In particular, the invention shows that an isochronous oscillator can be obtained with pivots which satisfy two inequalities at the same time: $0.15 \leq (X=D/L) \leq 0.85$, and $\alpha$=60°.

Naturally, configurations where $\alpha$=0° are excluded, since the strips are no longer secant in projection, but parallel to each other.

The invention also concerns a timepiece movement including at least one such mechanical oscillator.

The invention also concerns a watch including such a timepiece movement.

BRIEF DESCRIPTION OF THE DRAWINGS

Other features and advantages of the invention will appear upon reading the following detailed description, with reference to the annexed drawings, in which.

DETAILED DESCRIPTION OF PREFERRED EMBODIMENTS

Figure 1:
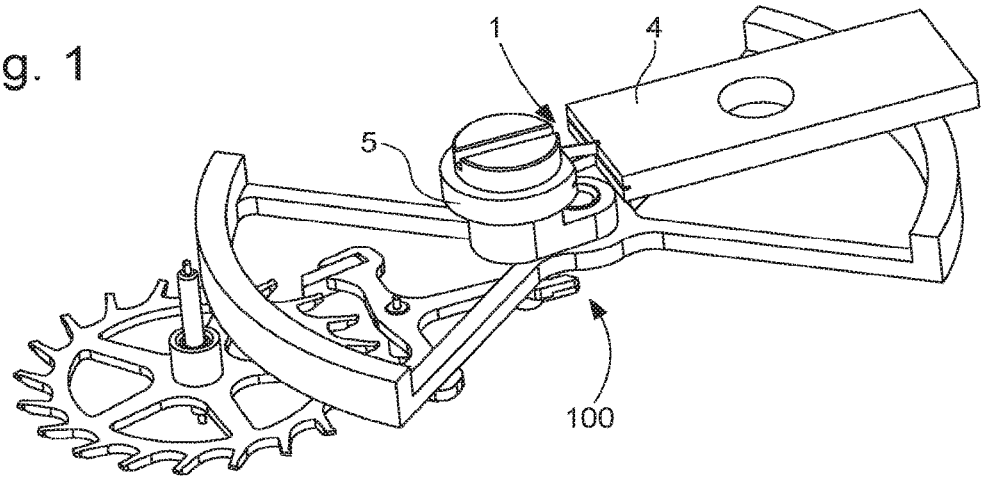
FIG. 1 represents a schematic perspective view of a first variant of a mechanical oscillator, which includes a rigid support element, of elongated shape, for attachment thereof to a plate of the movement or suchlike, to which is suspended a solid inertial element by two first separate flexible strips, crossed in projection onto the oscillation plane of this inertial element, which cooperates with a conventional Swiss lever escapement with a standard escape wheel.

The invention concerns a mechanical timepiece oscillator 100, comprising at least one rigid support element 4 directly or indirectly fixed to a plate 900, and a solid inertial element 5. This oscillator 100 includes, between rigid support element 4 and solid inertial element 5, a flexure bearing mechanism 200. This flexure bearing mechanism includes at least two first flexible strips 31, 32, which support solid inertial element 5 and are arranged to return it to a rest position. This solid inertial element 5 is arranged to oscillate angularly in an oscillation plane about said rest position.

The two first flexible strips 31 and 32 do not touch each other, and, in the rest position, their projections onto the oscillation plane intersect at a crossing point P, in immediately proximity to which or through which passes the axis of rotation of solid inertial element 5 perpendicularly to the oscillation plane. All the geometric elements described hereinafter should be considered to be in the rest position of the stopped oscillator, unless otherwise stated.

FIGS. 1 to 4 illustrate a first variant with a rigid support element 4 and a solid inertial element connected by two first flexible strips 31, 32.

The embedding points of first flexible strips 31, 32 in rigid support element 4 and second solid inertial element 5 define at least two strip directions DL1, DL2, which are parallel to the oscillation plane and which form between them, in projection onto the oscillation plane, a vertex angle $\alpha$.

The position of crossing point P is defined by the ratio X=D/L where D is the distance between the projection, onto the oscillation plane, of one of the embedding points of first strips 31, 32 in first rigid support element 4 and crossing point P, and where L is the total length of the projection, onto the oscillation plane, of the strip 31, 32 concerned. And the value of ratio D/L is comprised between 0 and 1, and vertex angle $\alpha$ is less than or equal to 70°.

Advantageously, vertex angle $\alpha$ is less than or equal to 60° and at the same time, for each first flexible strip 31, 32, the embedding point ratio D1/L1, D2/L2, is comprised between 0.15 and 0.85 inclusive.

Figure 2:
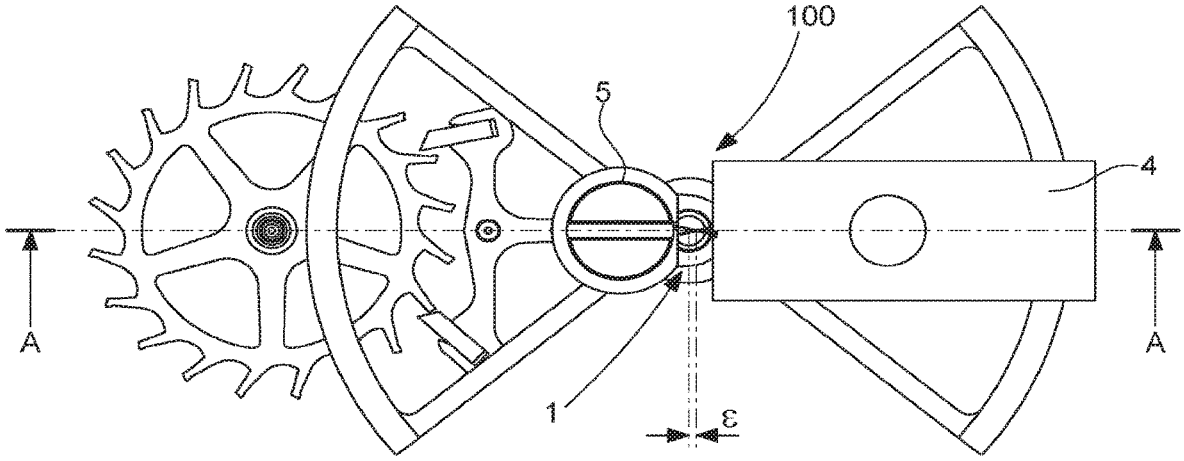
FIG. 2 represents a schematic, plan view of the oscillator of FIG. 1.
Figure 3:
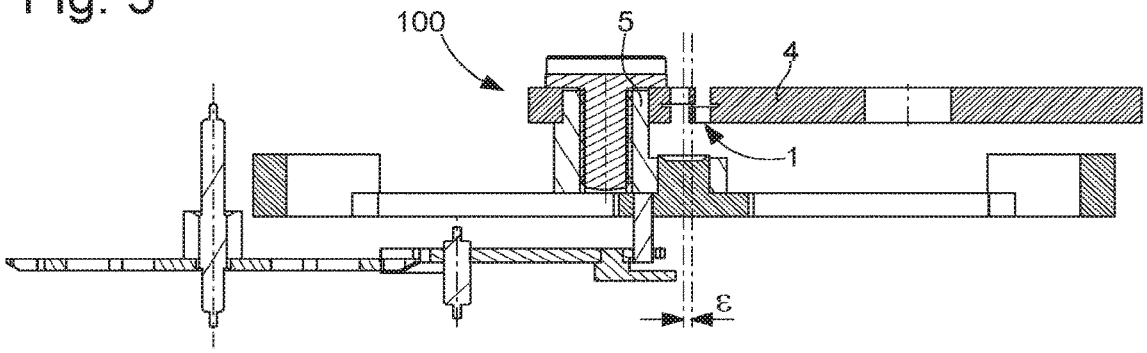
FIG. 3 represents a schematic cross-section through the crossing axis of the strips, of the oscillator of FIG. 1.
Figure 4:
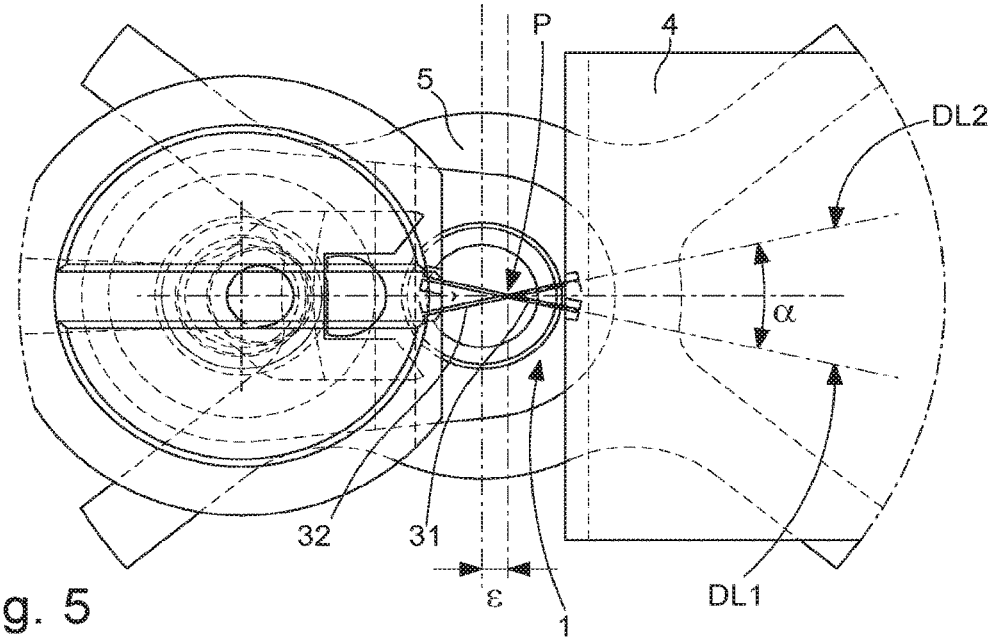
FIG. 4 represents a schematic view of a detail of FIG. 2, showing the offset between the crossing point of the strips and the projection of the centre of mass of the resonator, this detail with the offset being applicable in the same manner to the different variants described hereinafter.

In particular, as seen in FIGS. 2 to 4, the centre of mass of oscillator 100 in its rest position is separated from crossing point P by an offset $\varepsilon$ which is comprised between 10% and 20% of the total length L of the projection, onto the oscillation plane, of strip 31, 32. More particularly still, offset $\varepsilon$ is comprised between 12% and 18% of the total length L of the projection, onto the oscillation plane, of strip 31, 32.

More particularly, and as illustrated in the Figures, the first strips 31, 32, and their embedding points define together a pivot 1 which, in projection onto the oscillation plane, is symmetrical with respect to an axis of symmetry AA passing through crossing point P.

More particularly, when pivot 1 is symmetrical with respect to axis of symmetry AA, in the rest position, in projection onto the oscillation plane, the centre of mass of solid inertial element 5 is located on axis of symmetry AA of pivot 1. In projection, this centre of mass may or may not coincide with crossing point P.

More particularly still, the centre of mass of solid inertial element 5 is located at a non-zero distance from crossing point P corresponding to the axis of rotation of solid inertial element 5, as seen in FIGS. 2 to 4.

In particular, in projection onto the oscillation plane, the centre of mass of solid inertial element 5 is located on axis of symmetry AA of pivot 1, and is located at a non-zero distance from crossing point P, which is comprised between 0.1 times and 0.2 times the total length L of the projection onto the oscillation plane of strip 31, 32.

More particularly, the first strips 31 and 32 are straight strips.

More particularly still, vertex angle α is less than or equal to 50°, or is less than or equal to 40°, or less than or equal to 35°, or less than or equal to 30°.

Figure 5:
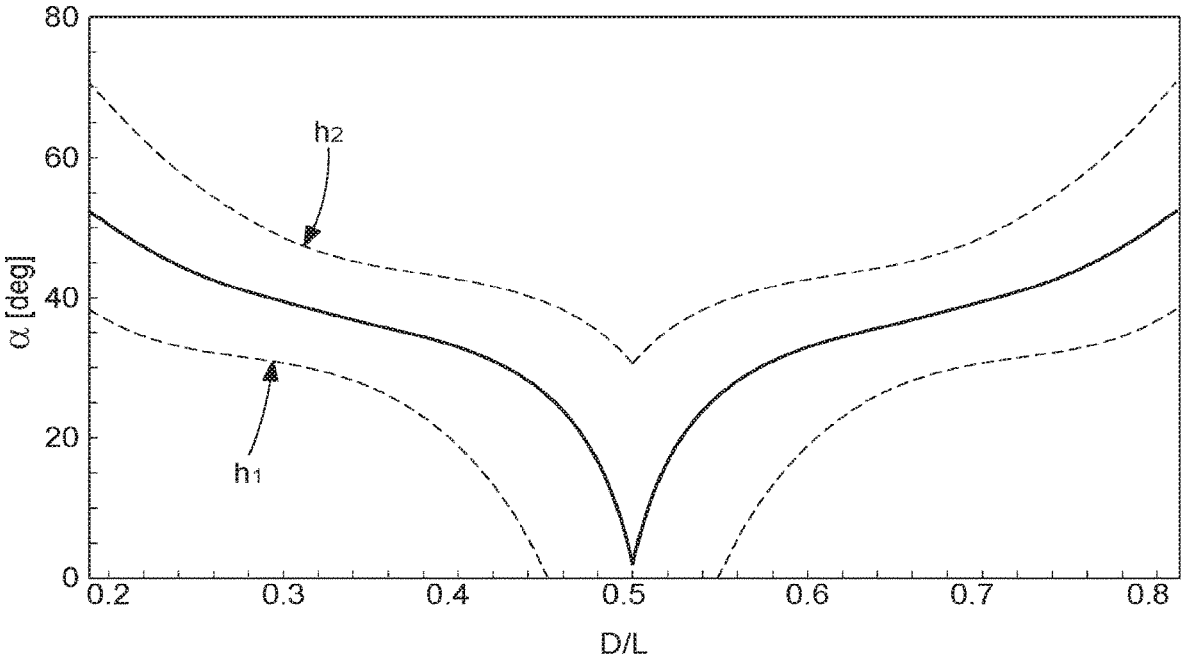
FIG. 5 is a graph with, on the abscissa, ratio X=D/L between, on the one hand, the distance D from the embedding point of a strip in the stationary mass and the crossing point, and on the other hand, the total length L of the same strip between its two opposite embedding points, and on the ordinate, the vertex angle of the crossing point of the flexible strips, and which defines two upper and lower curves, in a dash line, which bound the acceptable domain between these parameters to ensure isochronism, with the solid line curve corresponding to an advantageous value.
Figure 9:
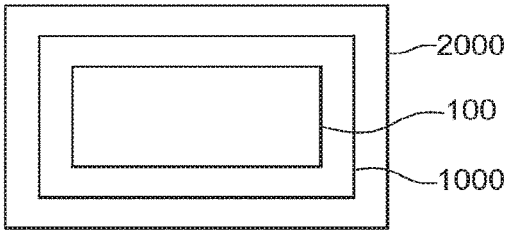
FIG. 9 is a block diagram representing a watch which includes a movement with such a resonator.

More particularly, the embedding point ratio D1/L1, D2/L2 is comprised between 0.15 and 0.49 inclusive, or between 0.51 and 0.85 inclusive, as seen in FIG. 5.

In a variant, and more particularly according to the embodiment of FIG. 5, vertex angle α is less than or equal to 50°, and embedding point ratio D1/L1, D2/L2 is comprised between 0.25 and 0.75 inclusive.

In a variant, and more particularly according to the embodiment of FIG. 5, vertex angle α is less than or equal to 40°, and embedding point ratio D1/L1, D2/L2 is comprised between 0.30 and 0.70 inclusive.

In a variant, and more particularly according to the embodiment of FIG. 5, vertex angle α is less than or equal to 35°, and embedding point ratio D1/L1, D2/L2 is comprised between 0.40 and 0.60 inclusive.

Advantageously, and as seen in FIG. 5, vertex angle α and ratio X=D/L satisfy the relation:

$$h1(D/L)<\alpha<h2(D/L),$$

where, for $0.2\leq X<0.5$:

$$h1(X)=116-473*(X+0.05)+3962*(X+0.05)^3-6000*(X+0.05)^4,$$

$$h2(X)=128-473*(X-0.05)+3962*(X-0.05)^3-6000*(X-0.05)^4,$$

for $0.5<X\leq 0.8$:

$$h1(X)=116-473*(1.05-X)+3962*(1.05-X)^3-6000*(1.05-X)^4,$$

$$h2(X)=128-473*(0.95-X)+3962*(0.95-X)^3-6000*(0.95-X)^4.$$

More particularly, and especially in the non-limiting embodiment illustrated by the Figures, first flexible strips 31 and 32 have the same length L, and the same distance D.

More particularly, between their embedding points, these first flexible strips 31 and 32 are identical.

Figure 6:
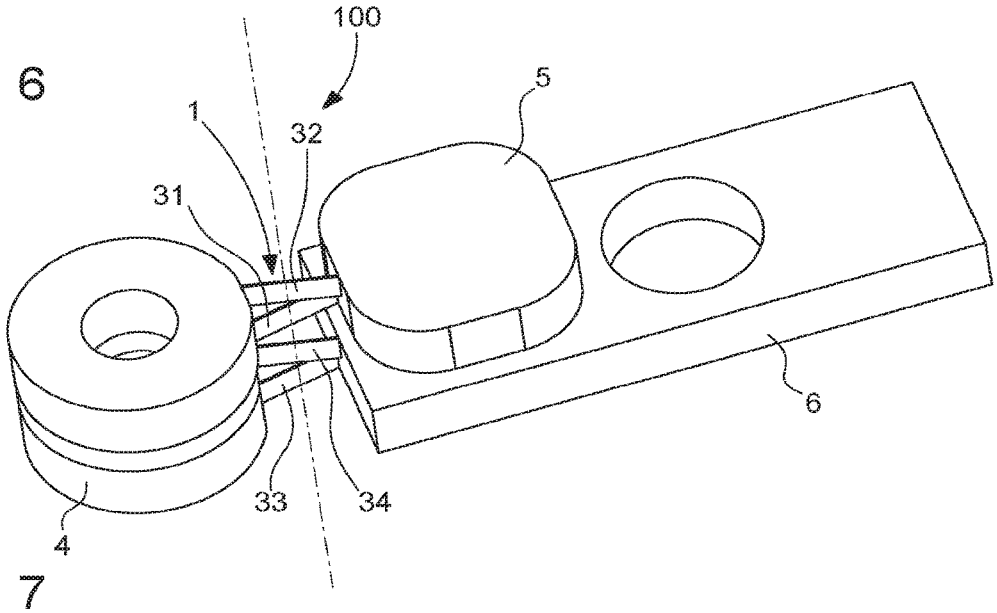
FIG. 6 represents, in a similar manner to FIG. 1, a second variant of the mechanical oscillator, wherein the rigid support element, of elongated shape, is also movable relative to a stationary structure, and is carried by a third rigid element, by means of a second set of flexible strips, arranged in a similar manner to the first flexible strips, with the second inertial element also being arranged to cooperate with a conventional escapement mechanism (not represented).
Figure 7:
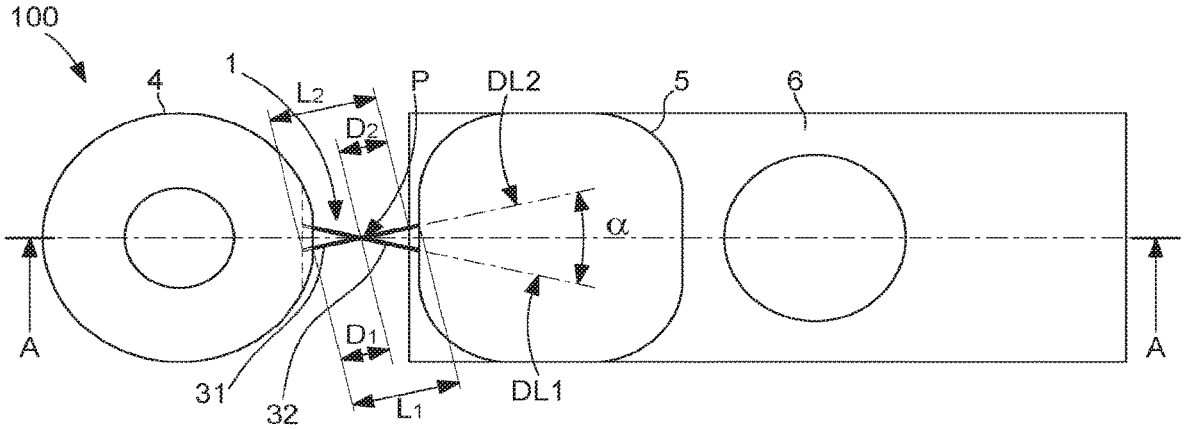
FIG. 7 represents a schematic, plan view of the oscillator of FIG. 6.
Figure 8:
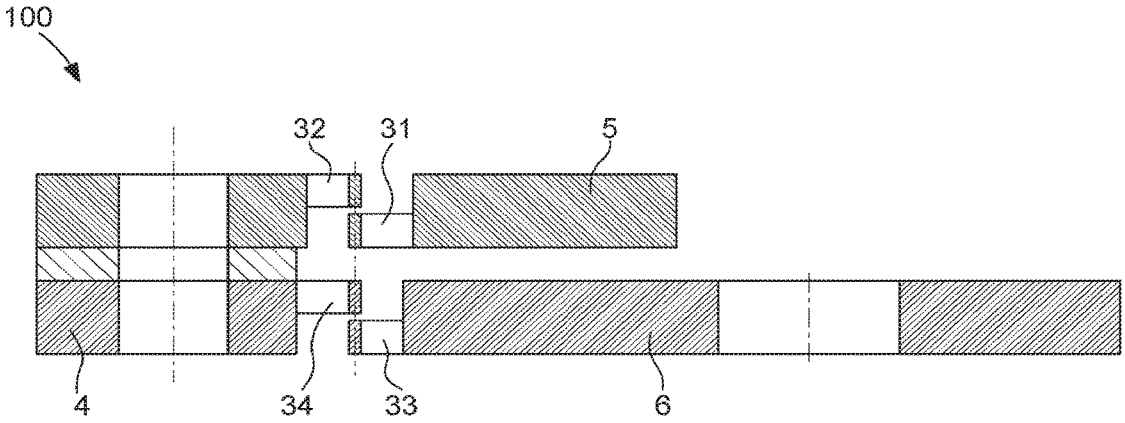
FIG. 8 represents a schematic cross-section through the crossing axis of the strips, of the oscillator of FIG. 1.
Figure 10:
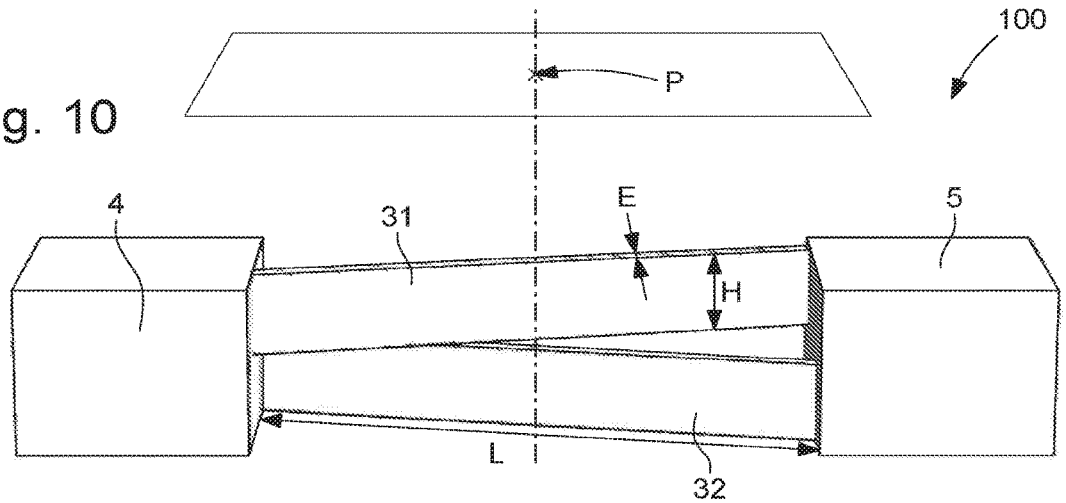
FIG. 10 represents a schematic, perspective view of a bearing with flexible strips crossed in projection, between a stationary structure and an inertial element.
Figure 11:
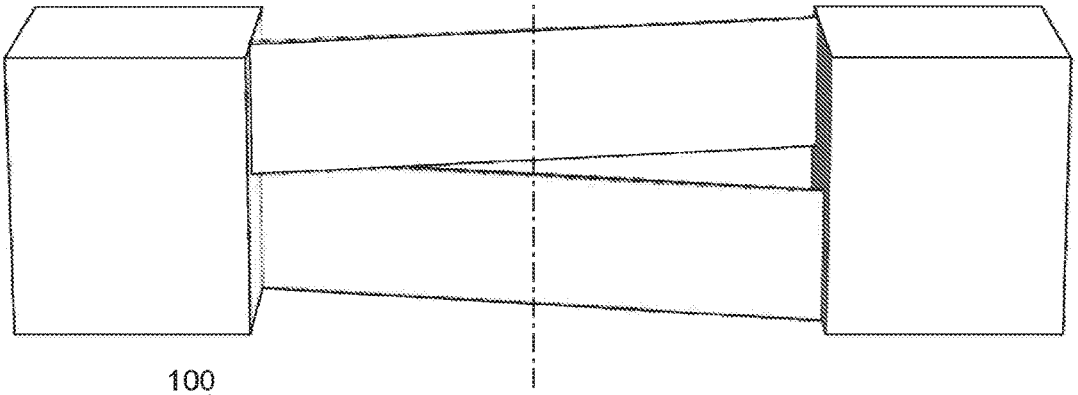
FIG. 11 represents, in a similar manner to FIG. 10, a theoretical flexure bearing wherein each strip has a higher aspect ratio than that of the strips of FIG. 10.
Figure 12:
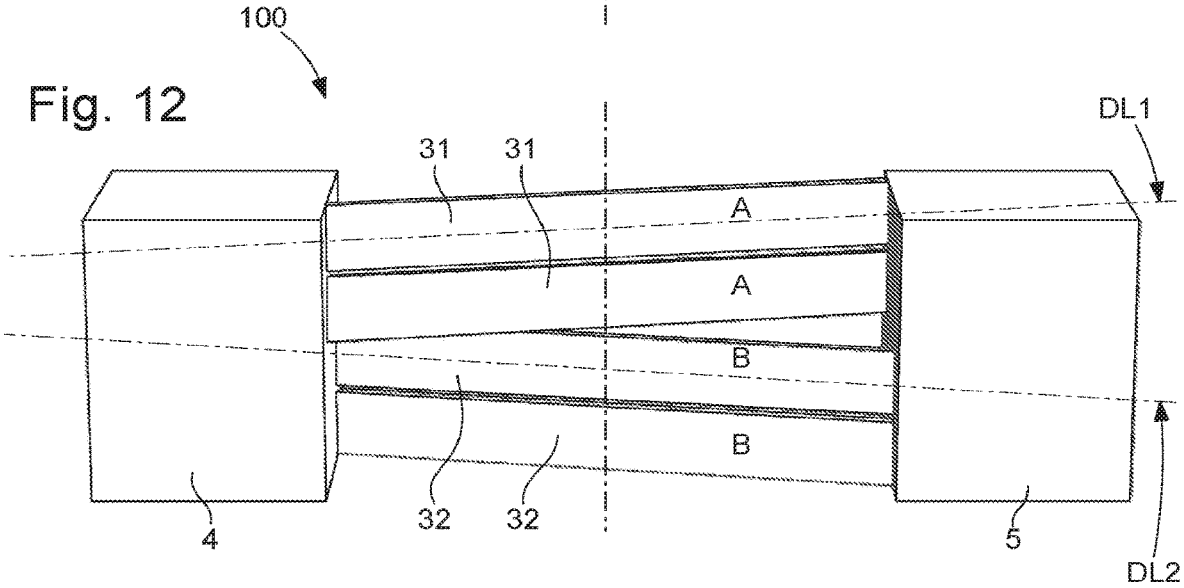
FIG. 12 represents, in a similar manner to FIG. 10, a flexure bearing, equivalent in terms of elastic return to the theoretical bearing of FIG. 11, but having a higher number of strips, wherein each has an aspect ratio lower than 10. In this variant, two basic strips of a first type are superposed in a first direction, and cross in projection two basic strips of a second type which are also superposed and extend in a second direction.
Figure 13:
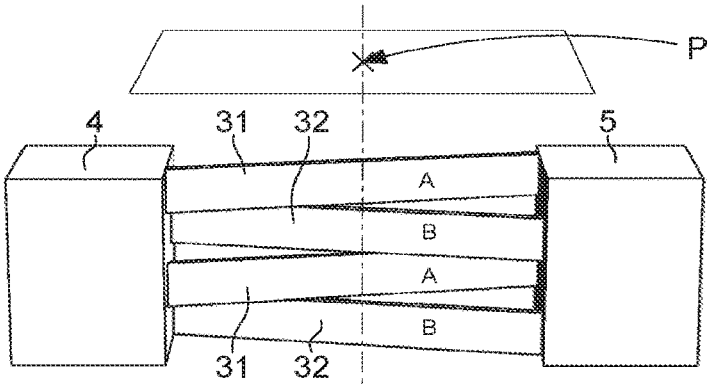
FIG. 13 represents, in a similar manner to FIG. 12, another flexure bearing in which the four strips are arranged alternately.
Figure 14:
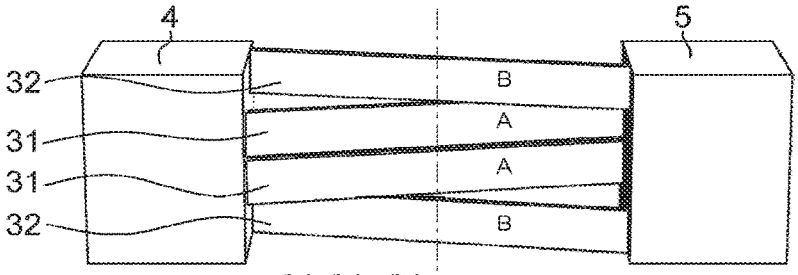
FIG. 14 represents, in a similar manner to FIG. 12, yet another flexure bearing, in which the four strips include two basic strips of a first type in a first direction, which flank two basic strips of a second type which are superposed and extend in a second direction.
Figure 15:
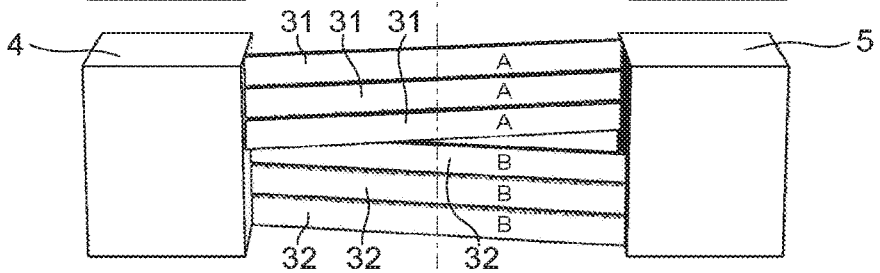
FIG. 15 represents, in a similar manner to FIG. 12, another flexure bearing including six strips superposed in threes.
Figure 16:
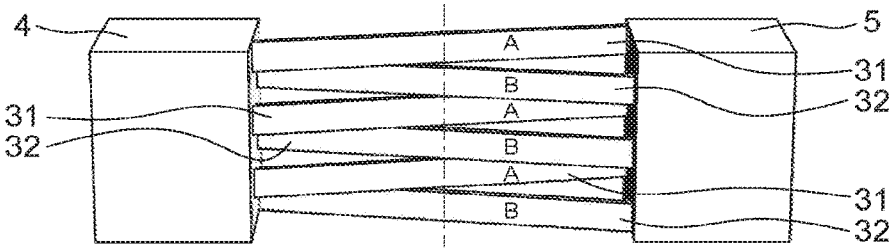
FIG. 16 represents, in a similar manner to FIG. 13, another flexure bearing in which the six strips are arranged alternately.
Figure 17:
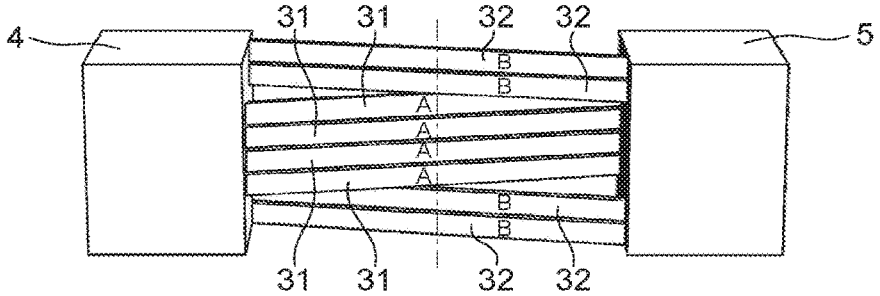
FIG. 17 represents, in a similar manner to FIG. 14, another flexure bearing, in which the eight strips include a first and a second superposition of two basic strips of a first type in a first direction, which flank four basic strips of a second type which are superposed and extend in a second direction.
Figure 18:
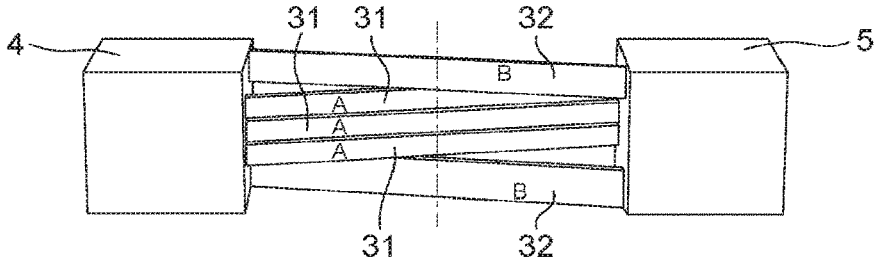
FIG. 18 represents, in a similar manner to FIG. 12, yet another flexure bearing, with an odd number of strips, in which the five strips include two basic strips of a first type in a first direction, which flank three basic strips of a second type which are superposed and extend in a second direction.

FIGS. 6 to 8 illustrate a second variant of mechanical oscillator 100, wherein rigid support element 4 is also directly or indirectly movable with respect to a stationary structure comprised in oscillator 100, and is carried by a third rigid element 6, by means of two second flexible strips 33, 34, arranged in a similar manner to first flexible strips 31, 32.

More particularly, in the non-limiting embodiment illustrated by the Figures, the projections of first flexible strips 31, 32 and second flexible strips 33, 34 onto the oscillation plane intersect at the same crossing point P.

In another particular embodiment (not illustrated), in the rest position, in projection onto the oscillation plane, the projections of first flexible strips 31, 32, and of second flexible strips 33, 34, onto the oscillation plane intersect at two distinct points both located on axis of symmetry AA of pivot 1, when pivot 1 is symmetrical with respect to axis of symmetry AA.

More particularly, the embedding points of second flexible strips 33, 34 in rigid support element 4 and third rigid element 6, define two strip directions that are parallel to the oscillation plane and form between them, in projection onto the oscillation plane, a vertex angle of the same bisector as vertex angle α of that of first flexible strips 31, 32. More particularly still, these two directions of second flexible strips 33, 34 have the same vertex angle α as first flexible strips 31, 32.

More particularly, second flexible strips 33, 34 are identical to first flexible strips 31, 32, as in the non-limiting example of the Figures.

More particularly, when pivot 1 is symmetrical with respect to axis of symmetry AA, in the rest position, in projection onto the oscillation plane, the centre of mass of solid inertial element 5 is located on axis of symmetry AA of pivot 1.

Similarly, and particularly when pivot 1 is symmetrical with respect to axis of symmetry AA, in the rest position, the centre of mass of rigid support element 4 is located, in projection onto the oscillation plane, on axis of symmetry AA of pivot 1.

In a particular variant, when pivot 1 is symmetrical with respect to axis of symmetry AA, in the rest position, in projection onto the oscillation plane, both the centre of mass of solid inertial element 5 and the centre of mass of rigid support element 4 are located on axis of symmetry AA of pivot 1. More particularly still, the projections of the centre of mass of solid inertial element 5 and of the centre of mass of rigid support element 4, on axis of symmetry AA of pivot 1, are coincident.

A particular configuration illustrated by the Figures for such superposed pivots is that wherein the projections of first flexible strips 31, 32 and of second flexible strips 33, 34 onto the oscillation plane intersect at the same crossing point P, which also corresponds to the projection of the centre of mass of solid inertial element 5, or at least is as close as possible thereto. More particularly, this same point also corresponds to the projection of the centre of mass of rigid support element 4. More particularly still, this same point also corresponds to the projection of the centre of mass of the entire oscillator 100.

In a particular variant of this superposed pivot configuration, when pivot 1 is symmetrical with respect to axis of symmetry AA, in the rest position, in projection onto the oscillation plane, the centre of mass of solid inertial element 5 is located on axis of symmetry AA of pivot 1 and at a non-zero distance from the crossing point corresponding to the axis of rotation of solid inertial element 5, which non-zero distance is comprised between 0.1 times and 0.2 times the total length L of the projection, onto the oscillation plane, of strip 33, 34, with an offset similar to offset ε of FIGS. 2 to 4.

Similarly and in particular, when pivot 1 is symmetrical with respect to axis of symmetry AA, the centre of mass of solid inertial element 5 is located, in projection onto the oscillation plane, on axis of symmetry AA of pivot 1 and at a non-zero distance from the crossing point corresponding to the axis of rotation of rigid support element 4, which non-zero distance is comprised between 0.1 times and 0.2 times the total length L of the projection, onto the plane of oscillation, of strip 31, 32.

Similarly, and particularly when pivot 1 is symmetrical with respect to axis of symmetry AA, the centre of mass of rigid support element 4 is located, in projection onto the oscillation plane, on axis of symmetry AA of pivot 1 and at a non-zero distance from the crossing point P corresponding to the axis of rotation of solid inertial element 5. In particular, this non-zero distance is comprised between 0.1 times and 0.2 times the total length L of the projection, onto the oscillation plane, of strip 33, 34.

Similarly, and particularly when pivot 1 is symmetrical with respect to axis of symmetry AA, the centre of mass of rigid support element 4 is located, in projection onto the oscillation plane, on axis of symmetry AA of pivot 1 and at a non-zero distance from the crossing point corresponding to the axis of rotation of rigid support element 4, which non-zero distance is comprised between 0.1 times and 0.2 times the total length L of the projection, onto the oscillation plane, of strip 31, 32.

Similarly, and in particular, the centre of mass of rigid support element 4 is located on axis of symmetry AA of pivot 1 and at a non-zero distance from crossing point P which is comprised between 0.1 times and 0.2 times the total length L of the projection onto the oscillation plane of strip 33, 34.

More particularly, and as seen in the variant of the Figures, when pivot 1 is symmetrical with respect to axis of symmetry AA, in projection onto the oscillation plane, the centre of mass of oscillator 100 in its rest position is located on axis of symmetry AA.

More particularly, solid inertial element 5 is elongated in the direction of axis of symmetry AA of pivot 1, when pivot 1 is symmetrical with respect to axis of symmetry AA. This is, for example, the case of FIGS. 1 to 4, where inertial element 5 includes a base on which is secured a conventional balance with long arms provided with rim sections or inertia blocks in an arc of a circle. The objective is to minimise the effect of external angular accelerations about the axis of symmetry of the pivot, since the strips have low rotational stiffness about this axis because of small angle $\alpha$.

The invention is well suited to a monolithic embodiment of the strips and the solid components that they join, made of micromachinable or at least partially amorphous material, by means of a MEMS or LIGA or similar process. In particular, in the case of a silicon embodiment, oscillator 100 is advantageously temperature compensated by the addition of silicon dioxide to the flexible silicon strips. In a variant, the strips can be assembled, for example embedded in grooves, or otherwise.

When there are two pivots in series, as in the case of FIGS. 6 to 9, the centre of mass can be placed on the axis of rotation, in the case where the arrangement is chosen so that undesired movements offset each other, which constitutes an advantageous but non-limiting variant. It should, however, be noted that it is not necessary to choose such an arrangement, and such an oscillator functions with two pivots in series without having to position the centre of mass on the axis of rotation. Of course, although the illustrated embodiments correspond to particular geometric alignment or symmetry configurations, it is clear that it is also possible to place one on top of the other two pivots which are different, or which have different crossing points, or non-aligned centres of mass, or to implement a higher number of sets of strips in series, with intermediate masses to further increase the amplitude of the balance.

In the illustrated variants, all the pivot axes, strip crossing points and centres of mass are coplanar, which is a particular, advantageous but non-limiting case.

It is understood that it is thus possible to obtain a large angular stroke: in any event greater than 30°, it may even reach 50° or 60°, which makes it compatible for combination with all the usual types of mechanical escapement—Swiss lever, detent, coaxial or otherwise.

It is also a matter of determining a practical solution that is equivalent to the theoretical use of a high aspect ratio value of the strips.

To this end, it is advantageous to subdivide the strips lengthwise, by replacing a single strip with a plurality of basic strips whose combined behaviour is equivalent, and wherein each of the basic strips has an aspect ratio limited to a threshold value. The aspect ratio of each basic strip is thus decreased compared to a single reference strip, to achieve optimum isochronism and position insensitivity.

Each strip 31, 32 has an aspect ratio RA=H/E, where H is the height of strips 31, 32, perpendicularly both to the oscillation plane and to the elongation of strip 31, 32, along length L, and wherein E is the thickness of the strip 31, 32 in the oscillation plane and perpendicularly to the elongation of strip 31, 32 along length L.

Preferably, aspect ratio RA=H/E is less than 10 for each strip 31, 32. More specifically this aspect ratio is lower than 8. And the total number of flexible strips 31, 32 is strictly greater than two.

More particularly, oscillator 100 includes a first number N1 of first strips called primary strips 31 extending in a first strip direction DL1, and a second number N2 of first secondary strips 32 extending in a second strip direction DL2, the first number N1 and second number N2 each being higher than or equal to two.

More particularly, the first number N1 is equal to the second number N2.

More particularly still, oscillator 100 includes at least one pair formed of one primary strip 31 extending in a first strip direction DL1, and one secondary strip 32 extending in a second strip direction DL2. And, in each pair, the primary strip 31 is identical to the secondary strip 32 except as regards orientation.

In a particular variant, oscillator 100 only includes pairs each formed of one primary strip 31 extending in a first strip direction DL1, and one secondary strip 32 extending in a second strip direction DL2 and, in each pair, the primary strip 31 is identical to the secondary strip 32, except as regards orientation.

In another variant, oscillator 100 includes at least one group of strips formed of one primary strip 31 extending in a first strip direction DL1, and a plurality of secondary strips 32 extending in a second strip direction DL2. And, in each case, in each group of strips, the elastic behaviour of primary strip 31 is identical to the elastic behaviour resulting from the combination of the plurality of secondary strips 32, except as regards orientation.

It is also noted that, although the behaviour of one flexible strip depends on its aspect ratio RA, it also depends on the value of the curvature imparted thereto. Its deflected curve depends both on the aspect ratio value and the local radius of curvature value, especially at the embedding point. This is the reason why a symmetrical arrangement of the strips in planar projection is preferably adopted.

The invention concerns a timepiece movement 1000 including at least one such mechanical oscillator 100.

The invention also concerns a watch 2000 including at least one such timepiece movement 1000.

A suitable fabrication method consists in performing, for the various types of pivots below, the following operations:

For an AABB type pivot:

a. using a substrate with at least four layers, resulting, for example but not exclusively from the assembly of two SOI wafers;

b. front side etching, by a DRIE process, to obtain AA, especially etching two layers in one piece;

c. back side etching, by a DRIE process, to obtain BB, especially etching two layers in one piece;

d. partially separating the four layers by etching the buried oxide.

The high precision of the DRIE (deep reactive ion etching) process ensures very high positioning and alignment precision, less than or equal to 5 micrometres, owing to an optical alignment system, which ensures very good side-to-side alignment. Naturally, similar processes can be implemented, depending on the material chosen.

It is possible to implement substrates with a larger number of layers, particularly a substrate with six available layers, for example, by assembling two DSOI, to obtain an AAABBB type structure.

A variant for obtaining a same AABB type pivot consists in:

a. using two standard SOI substrates with two layers;

b. DRIE etching the first substrate, on the front side to obtain A, on the back side to obtain A;

c. DRIE etching the second substrate, on the front side to obtain B, on the back side to obtain B; as an alternative to operations b and c, it is possible to etch through the two layers in one operation on the first substrate and on the second substrate, without performing a front side and back side etch.

d. performing the wafer-to-wafer bonding of two substrates or part-to-part assembly of the individual components, to obtain AABB. Correct alignment of the geometries is then linked to the specification of the wafer-to-wafer bonding machine or to the part-to-part process, in a manner well known to those skilled in the art.

For an ABAB type pivot:

a. using two standard SOI substrates with two layers;

b. DRIE etching the first substrate, on the front side to obtain A, on the back side to obtain B;

b. DRIE etching the second substrate, on the front side to obtain A, on the back side to obtain B;

d. performing the wafer-to-wafer bonding of two substrates or part-to-part assembly of the individual components, to obtain ABAB. As above, correct alignment of the geometries is then linked to the specification of the wafer-to-wafer bonding machine or to the part-to-part process.

Many other variants of the method can be implemented, depending on the number of strips and available equipment.

Standard fabrication methods by DRIE silicon etching do not yet allow easy fabrication of a monolithic pivot having more than two distinct levels. It is thus easier to fabricate separate parts which are then assembled. However, sensitivity to assembly errors requires precision of more than a micrometre, to obtain optimal isochronism and/or position insensitivity. To overcome this problem, it is necessary to adopt a fabrication strategy which is described hereinafter.

Figure 19:
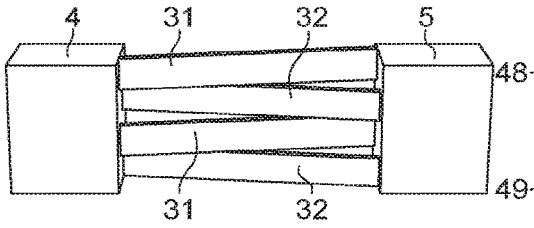
FIG. 19 is identical to FIG. 13.
Figure 20:
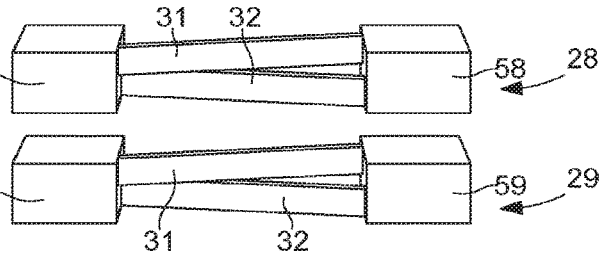
FIG. 20 shows the breakdown of this flexure bearing with four alternate strips into two pivot sub-units with two strips.
Figure 21:
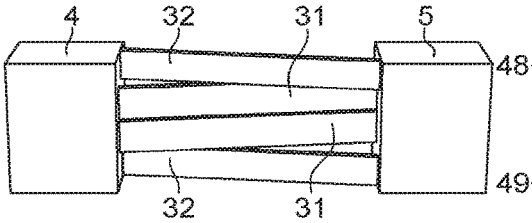
FIG. 21 is identical to FIG. 14.
Figure 22:
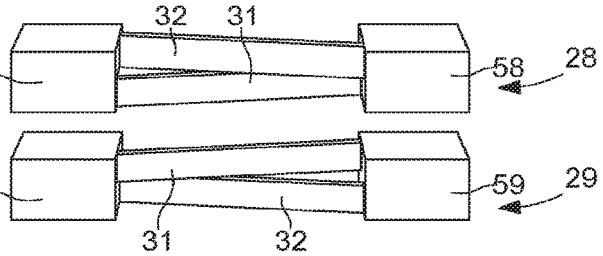
FIG. 22 shows the breakdown of this flexure bearing with four strips in a flanked arrangement, into two pivot sub-units with two strips.

In a first step, two strips having different directions must be assembled with great precision. The invention proposes to divide the flexure bearing, or pivot, into sub-units composed of pivots with two strips, for example an upper sub-unit and a lower sub-unit, in the case of a flexure bearing comprising four strips, as seen in FIG. 19, with four alternate strips, broken down into two pivot sub-units with two strips. FIGS. 21 and 22 illustrate a similar breakdown in the case of strips that are flanked rather than alternate strips. Each sub-unit is fabricated by DRIE etching on two levels (SOI wafer etched on both sides) in order to ensure sufficient alignment precision.

The upper sub-unit is then assembled to the lower sub-unit.

This assembly process can be performed by any conventional method: using alignment pins and screws, or bonding, or wafer fusion bonding, or welding, or brazing, or any other method known to those skilled in the art.

Figure 23:
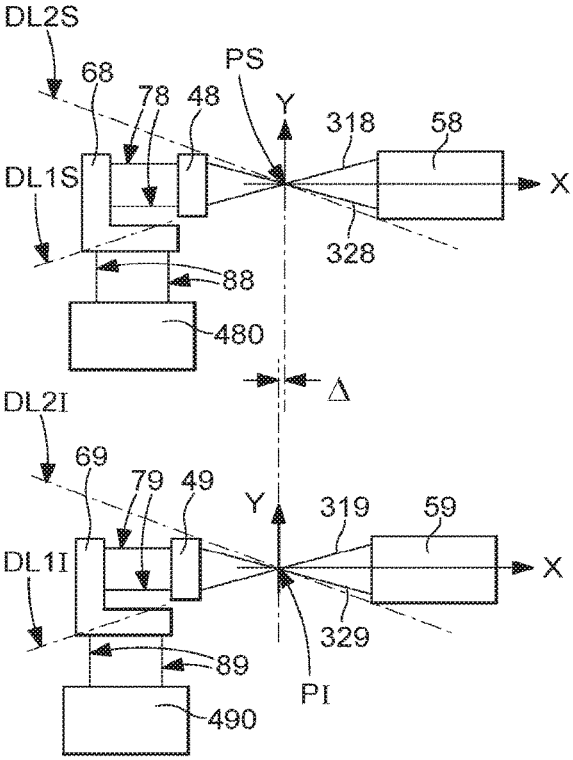
FIG. 23 represents, in a schematic manner, and returned to the same plane, the upper part and the lower part of an oscillator with such a flexure bearing broken down into several sub-units, in this case an upper level and a lower level, with translational tables inserted between the stationary support and the bearing point of the strips towards the inertial element, these translational tables including elastic flexure bearings in directions X and Y of the bisectors to the directions of projection of the strips.

An assembly error is manifested by a small offset Δ of the axes of rotation of the upper and lower sub-units, so that the rotational motion of the resonator imposed by the upper sub-unit is not aligned with the rotational motion imposed by the lower sub-unit. To stop this offset creating excess stress, the mechanism includes at least one translational table, whose unrestricted movement can absorb the discrepancy between the two rotations of distinct axes. At least one of the translational tables must be flexible enough to prevent the discrepancy in movement impairing isochronism. In the case where two identical translational tables are implemented, as represented in FIG. 23, they must be flexible enough to prevent the discrepancy in movement impairing isochronism, and stiff enough for the position of the pivot to be clearly determined. Calculations show that these conditions are not contradictory if the offset between the axes of rotation is less than 10 micrometres, which can be achieved by conventional assembly processes. Naturally, the precision of such an assembly can be improved with complementary etches, of the mortise and tenon type, or with a plurality of mortise and tenon assemblies forming a non-zero angle between them, or any other arrangement known in precision mechanics.

More particularly, as seen in the Figures, flexure bearing mechanism 200 includes, superposed on each other, at least one upper level 28 and at least one lower level 29.

The upper sub-unit includes an upper level 28, which includes, between an upper support 48 and an upper inertial element 58, at least one upper primary strip 318 extending in a first upper strip direction DL1S and an upper secondary strip 328 extending in a second upper strip direction DL2S, crossed in projection at an upper crossing point PS.

The lower sub-unit includes a lower level 29, which includes, between a lower support 49 and a lower inertial element 59, at least one lower primary strip 319 extending in a first lower strip direction DL1I and a lower secondary strip 329 extending in a second lower strip direction DL2I, crossed in projection at a lower crossing point PI, at a distance, at rest, from upper crossing point PS by a shift.

And at least upper level 28 or lower level 29 includes, between plate 900 and upper support 48, or respectively lower support 49, an upper translational table 308, or respectively a lower translational table 309, which includes at least one elastic connection which allows translation along one or two axes of freedom in the oscillation plane, and whose translational stiffness along these two axes is lower than that of each flexible strip 31, 32, 333, 34, 318, 319, 328, 329 comprised in flexure bearing mechanism 200.

It is to be noted that this elastic connection does not allow rotations about axes parallel to the resonator axis.

It will be noted that it is not necessary for upper directions DL1S and DL2S of upper level 28 to be identical to lower directions DL1I and DL2I of lower level 29. Preferably, they have the same bissectors.

More particularly, point P, through which the axis of rotation of inertial element 5 passes, is located between upper crossing point PS and lower crossing point PI, exactly in the middle if the flexure bearing mechanism 200 includes two upper and lower translational tables 308 and 309 which are identical. In a variant, this point P is located exactly on lower crossing point PI if lower level 29 does not have a translational table, or on upper crossing point PS if upper level 28 does not have a translational table.

Preferably, oscillator 100 includes, for each flexure bearing mechanism 200 comprised therein, a single solid inertial element 5. More particularly, there is only one flexure bearing mechanism 200 and only one solid inertial element 5.

Naturally, the preferred configuration of translational tables 308 and 309 illustrated by the Figures is not limiting. These translational tables 308 and 309 can also be located between inertial element 5 and the embedding points on the inertial element side.

If the axes of the bissectors of the angles formed between the projections of the flexible strips on a common parallel plane are defined as X and Y, the combination of the translational tables, along axis X and along axis Y, must be more flexible than the flexure pivot along the same axes. This rule is valid regardless of the number of levels, the accumulation resulting from the combination of all the tables, in translation, along axis X and along axis Y, must be more flexible than the flexure pivot. The elastic connection of upper translational table 308 or respectively lower translational table 309, along one or two axes of freedom in the oscillation plane, is thus preferably an elastic connection along these axes X and Y.

The additional storage of elastic energy in the translational table(s), which results from the discrepancy in movement, is added to the main energy storage of the pivot, and tends to disrupt isochronism, unless the additional storage value is much lower than that of the main storage. This is why the elastic connections in the translational tables must be much more flexible than those of the flexure pivot.

More particularly, according to the invention, upper level 28 and lower level 29 each include, between plate 900 and upper support 48, and respectively lower support 49, an upper translational table 308, or respectively a lower translational table 309, comprising at least one elastic connection along one or two axes of freedom in the oscillation plane, and whose stiffness is lower than that of each flexible strip.

When there is one translational table per level, they are not necessarily identical to each other.

A variant consists in using two different translational tables, wherein the first is flexible so that the discrepancy in movement does not impair isochronism, and the second is stiff to ensure positioning of the pivot.

In another variant, one level can include a translational table and the other level can have a rigid attachment.

Upper inertial element 58 and lower inertial element 59 form all or part of solid inertial element 5 and are rigidly connected, directly or indirectly, to each other. Upper support 48 and lower support 49 are connected, depending on the case, directly or via an upper translational table 308 or respectively a lower translational table 309, to a rigid upper part 480, respectively a rigid lower part 490, which are rigidly connected to rigid support element 4, or to plate 900.

Figure 24:
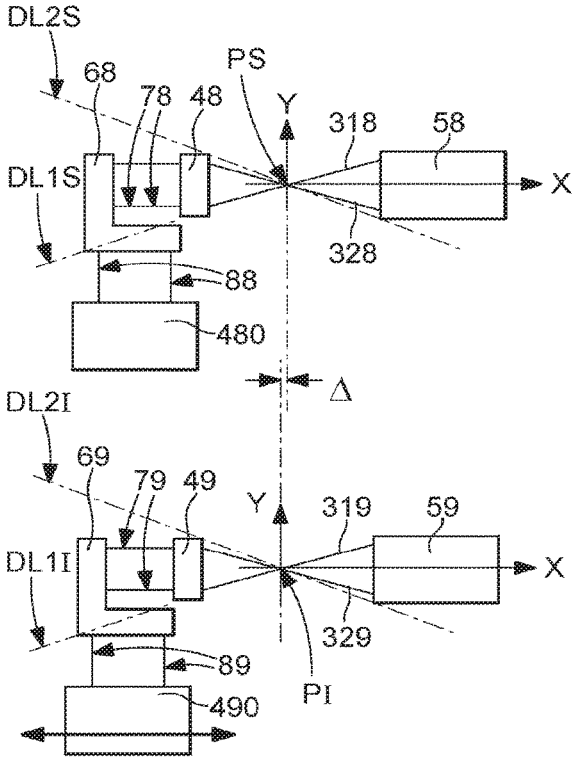
FIG. 24 is similar to FIG. 23 and includes a position adjustment at X on a lower rigid part, in order to change the offset between the projections of the crossing points of the upper and lower strips.

FIGS. 23 and 24 show an example of such a connection. An upper translational table 308 includes, between upper support 48 and an upper intermediate mass 68, first flexible elastic connections 78 extending in direction X, and, between upper intermediate mass 68 and upper rigid part 480, second flexible elastic connections 88 extending in direction Y. Likewise, an upper translational table 309 includes, between upper support 49 and an upper intermediate mass 69, first flexible elastic connections 79 extending in direction X, and, between upper intermediate mass 69 and upper rigid part 490, second flexible elastic connections 89 extending in direction Y.

Thus, the movement of the translational table, or advantageously translational tables, can absorb any discrepancy between the rotations of the upper sub-unit and the lower sub-unit. Further, each translational table participates in protecting the mechanism against high accelerations, during a fall or impact, for example.

It is clear that the assembly described above with reference to the first step makes any added anisochronism negligible, provided that assembly error Δ is sufficiently small.

On the other hand, one could decide to deliberately exaggerate assembly error Δ in order to introduce anisochronism in a controlled manner, for example to compensate for a loss at the escapement. It is then advantageous to make at least one of the embedding points in the plate movable and adjustable, i.e. upper support 48 and/or lower support 49 in the case of the particular non-limiting variant illustrated. Indeed, adjusting the relative position of these two embedding points changes the rigidity of translational tables 308, 309, which has the effect of adjusting the added anisochronism. Such an adjustment can easily be carried out with a cam and groove combination, or by any other solution known to watchmakers.

In short, by moving the position of at least one of the embedding points in the plate, as seen in FIG. 24, it is possible to adjust the anisochronism produced by assembly error Δ.

In short, this particular arrangement with at least one translational table makes it possible to guarantee alignment between the upper and lower stages, and to avoid the high stresses that the strips would be subjected to if the upper and lower stages did not follow the same trajectory.

Yet another alternative consists in providing the mechanism with an upper translational table 308 and a lower translational table 309, with an upper support 48 and a lower support 49 which are no longer rigidly connected to rigid support element 4 or to plate 900, but which are restricted to opposite planar movements at X and Y, by a brace type connection or similar, with respect to a fixed axis of rigid support element 4, or of plate 900. This solution has the advantage of allowing anisochronism to be adjusted without thereby slightly moving the axis of rotation of the resonator.

Figure 25:
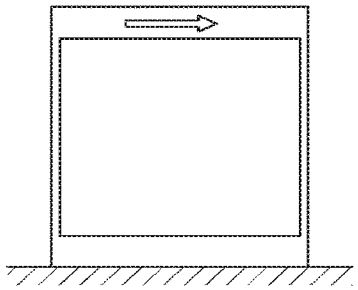
FIGS. 25 to 27 illustrate other variants of translational tables.
Figure 26:
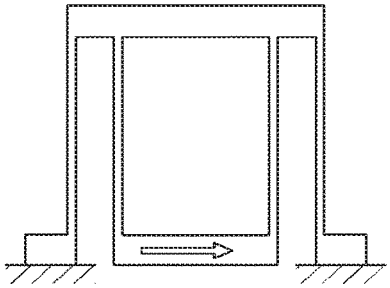
Figure 27:
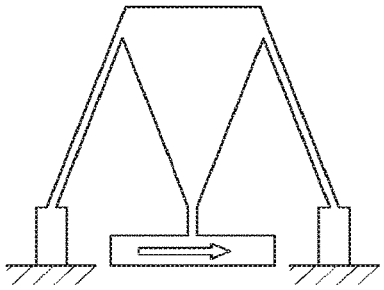

It is clear that the translational tables, which form translational flexure bearings, can be made in many different ways. Those skilled in the art will find examples in the following reference works: [1] S. Henein, Conception des guidages flexibles. PPUR, [2] Larry L. Howell, Handbook of compliant mechanisms, WILEY), or [3] Zeyi Wu and Qingsong Xu, Actuators 2018. Non-limiting examples are illustrated in FIGS. 25 to 27.

Figure 28:
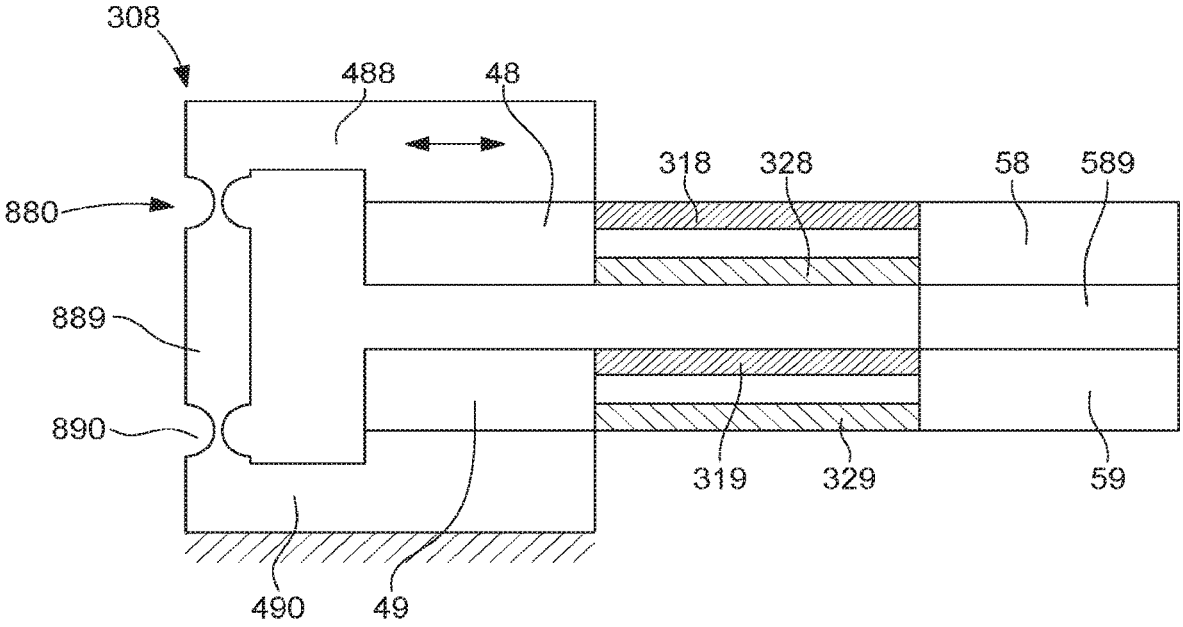
FIG. 28 represents a schematic, side view of the upper part and lower part of an oscillator with a flexure bearing broken down into two sub-units, in this case an upper level and a lower level, with a translational table inserted between the stationary support and the upper bearing point of the upper strips towards the inertial element.

FIG. 28 illustrates a simplified example with a translational table with a connection via neck portions: upper support 48 is connected to an intermediate element 488 suspended by a first elastic neck portion 880 to a second intermediate element 889 with a second neck portion 890 which forms the elastic connection with the lower rigid part 490, rigidly connected to plate 900. In this example, upper inertial element 58 and lower inertial element 59 are connected to another intermediate element 589 to form therewith solid inertial element 5.

The invention claimed is:

1. A mechanical timepiece oscillator, comprising:

a flexure bearing mechanism disposed between a first rigid support element directly or indirectly fixed to a plate and a solid inertial element, the flexure bearing mechanism including at least two first flexible strips which support the solid inertial element and are configured to return the solid inertial element to a rest position, wherein the solid inertial element is configured to oscillate angularly in an oscillation plane about the rest position, the first flexible strips do not touch each other, projections of the first flexible strips onto the oscillation plane cross, in the rest position, at a crossing point, an axis of rotation of the solid inertial element passes proximate to the crossing point, the axis of rotation being perpendicular to the oscillation plane, the flexure bearing mechanism includes at least one upper level and at least one lower level superposed on each other, the at least one upper level includes, between an upper support and the solid inertial element, at least one upper primary strip extending in a first upper strip direction and one upper secondary strip extending in a second upper strip direction, the at least one upper primary strip and the one upper secondary strip being projected onto and crossed at an upper crossing point, the at least one lower level includes, between a lower support and the solid inertial element, at least one lower primary strip extending in a first lower strip direction and one lower secondary strip extending in a second lower strip direction, the at least one lower primary strip and the one lower secondary strip being projected onto and crossed at a lower crossing point, the upper level includes, between the plate and the upper support, an upper translational table, the lower level includes, between the plate and the lower support, a lower translational table, the upper translational table and the lower translational table comprise at least one elastic connection along one or two axes of freedom in the oscillation plane, and a stiffness of the at least one elastic connection is lower than a stiffness of the upper level and a stiffness of the lower level.

2. The mechanical timepiece oscillator according to claim 1, wherein the at least one elastic connection along one or two axes of freedom in the oscillation plane is an elastic connection along X and Y axes of bisectors of angles formed between the projections of the first flexible strips of the flexure bearing mechanism onto a common parallel plane.

3. The mechanical timepiece oscillator according to claim 1, wherein a first strip direction and a second strip direction, parallel the oscillation plane, form therebetween, in the rest position, a vertex angle projected onto the oscillation plane, and a position of the crossing point is defined by an embedding point ratio X=D/L, where D is a distance between the projection, onto the oscillation plane, of one of two embedding points of the first flexible strips in the first rigid support element and the crossing point, L is a total length of the projection, onto the oscillation plane, of the first flexible strips, the centre of mass of the oscillator in the rest position is separated from the crossing point by an offset, the offset is between 12% and 18% of the total projected length L, onto the oscillation plane, of the first flexible strips, the vertex angle is less than or equal to 60°, and the embedding point ratio is between 0.15 and 0.85 inclusive for each of the first flexible strips.

4. The mechanical timepiece oscillator according to claim 1, wherein each of the first flexible strips has an aspect ratio RA=H/E, where H is a height of the first flexible strip, the height being perpendicular both to the oscillation plane and to an elongation of the first flexible strip along a length L, E is a thickness of the first flexible strip in the oscillation plane, the first flexible strip being perpendicular to the elongation of the first flexible strip along the length L, the aspect ratio RA=H/E is less than 10 for the first flexible strip, and a total number of the first flexible strips is greater than two.

5. The mechanical timepiece oscillator according to claim 4, wherein the oscillator includes a first number of the first flexible strips, called primary strips, extending in the first strip direction, and a second number of the first flexible strips called secondary strips extending in the second strip direction, and the first number and the second number are each greater than or equal to two.

6. The mechanical timepiece oscillator according to claim 5, wherein the first number is equal to the second number.

7. The mechanical timepiece oscillator according to claim 5, wherein the oscillator includes at least one pair formed of one of the primary strips extending in the first strip direction, and one of the secondary strips extending in the second strip direction, and in each of the at least one pair, the one of the primary strips is identical to the one of the secondary strips, except as regards orientation.

8. The mechanical timepiece oscillator according to claim 7, wherein the oscillator includes only pairs formed of one of the primary strips extending in the first strip direction, and one of the secondary strips extending in the second strip direction, and in each of the pairs, the one of the primary strips is identical to the one of the secondary strips, except as regards orientation.

9. The mechanical timepiece oscillator according to claim 5, wherein the oscillator includes at least one group of strips formed of one of the primary strips extending in the first strip direction, and a plurality of the secondary strips extending in the second strip direction, and in each of the at least one group of strips, an elastic behaviour of the one of the primary strips is identical to an elastic behaviour resulting from the plurality of the secondary strips except as regards orientation.

10. The mechanical timepiece oscillator according to claim 1, wherein a first strip direction and a second strip direction, parallel the oscillation plane, form therebetween, in the rest position, a vertex angle projected onto the oscillation plane, and a position of the crossing point is defined by an embedding point ratio X=D/L, where D is a distance between the projection, onto the oscillation plane, of one of the two embedding points of the first flexible strips in the first rigid support element and the crossing point, L is a total length of the projection, onto the oscillation plane, of the first flexible strips in elongation of the first flexible strips, and the embedding point ratio between 0.15 and 0.49 inclusive or between 0.51 and 0.85 inclusive.

11. The mechanical timepiece oscillator according to claim 10, wherein the vertex angle is less than or equal to 50°, and the embedding point ratio is between 0.25 and 0.75 inclusive.

12. The mechanical timepiece oscillator according to claim 11, wherein the vertex angle is less than or equal to 40°, and the embedding point ratio is between 0.30 and 0.70 inclusive.

13. The mechanical timepiece oscillator according to claim 12, wherein the vertex angle is less than or equal to 35°, and the embedding point ratio is between 0.40 and 0.60 inclusive.

14. The mechanical timepiece oscillator according to claim 10, wherein the vertex angle is less than or equal to 30°.

15. The mechanical timepiece oscillator according to claim 10, wherein the vertex angle and the embedding point ratio X=D/L satisfy the relation $h1(D/L)<\alpha<h2(D/L)$, where, for $0.2 \leq X < 0.5$:

$$h1(X)=116-473*(X+0.05)+3962*(X+0.05)^3-6000(X+0.05)^4,$$

$$h2(X)=128-473*(X-0.05)+3962*(X-0.05)^3-6000*(X-0.05)^4,$$

for $0.5 < X \leq 0.8$:

$$h1(X)=116-473*(1.05-X)+3962*(1.05-X)^3-6000*(1.05-X)^4,$$

$$h2(X)=128-473*(0.95-X)+3962*(0.95-X)^3-6000*(0.95-X)^4.$$

16. The mechanical timepiece oscillator according to claim 1, wherein the first flexible strips are straight strips.

17. A timepiece movement including at least one mechanical timepiece oscillator according to claim 1.

18. A watch including at least one timepiece movement according to claim 17.

* * * * *